United States Patent [19]

Weber et al.

[11] 4,248,603

[45] Feb. 3, 1981

[54] METHOD AND TANK FOR PRODUCING HOT BRIQUETTES

[75] Inventors: Heinrich Weber, Recklinghausen; Horst Dungs, Herne; Fritz Ferdinand, Dülmen, all of Fed. Rep. of Germany; Yves Brasseur, Strassen; Henri Birscheidt, Lintgen, both of Luxembourg

[73] Assignees: Firma Carl Still GmbH & Co. KG, Fed. Rep. of Germany; Mecan Arbed S.A.R.L., Luxembourg

[21] Appl. No.: 76,379

[22] Filed: Sep. 17, 1979

[30] Foreign Application Priority Data

Sep. 29, 1978 [DE] Fed. Rep. of Germany ..... 2842425

[51] Int. Cl.[3] ..... C10L 5/28

[52] U.S. Cl. ..... 44/10 J; 44/2; 44/10 R; 34/167; 34/168; 34/180

[58] Field of Search ..... 44/10 R, 10 J, 2, 10 C, 44/11–13; 34/167, 168, 180; 75/42

[56] References Cited

U.S. PATENT DOCUMENTS

| | | | |
|---|---|---|---|
| 1,632,052 | 6/1927 | Zwoyer | 44/10 K |
| 1,920,327 | 8/1933 | Sewell | 44/12 |
| 2,610,115 | 9/1952 | Lykken | 44/2 |
| 3,181,488 | 5/1965 | Roe et al. | 34/168 |
| 4,187,079 | 2/1980 | Weber et al. | 44/10 C |

FOREIGN PATENT DOCUMENTS

| | | | |
|---|---|---|---|
| 1562473 | 2/1969 | France | 44/10 J |

*Primary Examiner*—Carl F. Dees
*Attorney, Agent, or Firm*—McGlew and Tuttle

[57] ABSTRACT

A method for producing hot briquettes, for example, for use in blast furnaces, and using a briquetting material of non-caking components, such as low temperature coke from bituminous coal and/or lignite, coke dust and/or oil coke and caking fat coal at temperatures between 430° C. and 540° C., comprising, delivering the briquetting material to a briquetting press to form briquette blanks, tempering and degassing the blanks by delivering the blanks into individual chambers in a closed system of several chambers having gas communication with each other so that there is partly changing amounts of gas generated in the individual chambers and the briquette blanks are formed into tempered briquettes, and applying an overpressure to the chambers to conduct the gases away from the chamber with one and the same overpressure. The equipment for the execution of the method comprises a hardening system in the form of a single cube-shaped tank having one corner which is inclined downwardly and which is divided into several substantially parallel narrow chambers by walls which are disposed parallel to the inclined outer surface and which has a channel above an upper lateral edge for charging hot briquettes into the individual chambers and also for conducting away gases formed during tempering in a path diagonally opposite to the charging channel. An emptying channel is located under the lower lateral edge of the tank.

10 Claims, 3 Drawing Figures

METHOD AND TANK FOR PRODUCING HOT BRIQUETTES

FIELD AND BACKGROUND OF THE INVENTION

This invention relates to blast furnace fuel in general and, in particular, to a new and useful method for the production of hot briquettes, using a briquetting material of non-caking components such as low temperature coke from bituminous coal and/or lignite, coke dust and/or oil coke and caking fat coal, at temperatures between 430° C. and 540° C. with subsequent rehardening and cooling of the blank, and to equipment for the execution of the method.

DESCRIPTION OF THE PRIOR ART

Various methods for producing hot briquettes have been developed based on the two-component method. It is known to temper briquettes after they are press-formed but are not yet completely solidified and, immediately after the pressing operation, at or slightly below the respective compacting temperature, thereby achieving a considerable increase in the spot compressive strength of the blanks, the minimum tempering time in minutes (t) at a medium tempering temperature in °C. (T) being chosen according to the relation $t=2000$ (T-390), but amounting to more than 30 minutes (See German patent disclosure No. 1,915,905).

Furthermore, according to the above-mentioned provisional patent, tempering the blanks is carried out immediately after their compaction in an atmosphere containing less than 3% oxygen. However, in the execution of this method, difficulties are encountered again and again in controlling the oxygen content in the hardening tanks. Up to the present time, they were sealed against the outside air by spraying in water below the layer of blanks during the tempering, and having the water vapor penetrate to the outside and, in part, also through the filled-in blanks, thus more or less preventing the penetration of air.

This has turned out to be disadvantageous since the water vapor escaping at the bottom, which is partly laden with solid particles, pollutes the environment. In addition, tempering dilutes the high-quality coal gas through water vapor and fumes originating from combustion with the air drawn in.

Until, now, the gas originating in tempering had to be burned off as it escaped from the top of the tempering tank or when it was diluted so as to be no longer combustible and it was then simply discharged into the atmosphere. Accordingly, utilization of the degassing gas, valuable per se, was not possible.

SUMMARY OF THE INVENTION

In arriving at the presently applied method of producing hot briquettes, the solidified hot briquettes are cooled by immersion and/or water sprinkling. The water vapor originating through cooling by sprinkling on belts or in open tanks and all solids and gases carried along by it get directly into the air and likewise pollute the environment. On the other hand, the water in which the rehardened blanks are dipped, in the other cooling method, becomes severely contaminated and must be cleaned again by costly purification processes.

Therefore, the present invention provides a method in which the environment is protected and a most extensive recovery of heating gases which otherwise would escape into the open is obtained and, in addition, the hitherto unused thermal energy is satisfactorily employed.

According to the invention, after leaving the briquetting press, the blanks are tempered and redegassed in a closed system of several chambers having gas communication with each other. The partly changing gas quantities generated in the various chambers are discharged together with one and the same overpressure.

According to the invention, the hot briquettes are maintained in air- and gastight chambers during their entire transport to and from rehardening and during tempering so that no emissions can reach the open. It is particularly favorable if, after briquetting, the blanks are tempered at temperatures of up to a maximum of 100° C. below the compacting temperature without additional input of heat and a rich gas consisting predominantly of hydrogen, methane and ethane is generated and discharged from all of the filled chambers with one and the same pressure.

When tempered in this way, the blanks, at the conclusion of tempering, have a residual content of volatiles of about 7.5%, and it has been demonstrated that this produce is excellent for use as blast furnace fuel.

Within the scope of the invention, the temperature of the blanks during tempering can also be raised by introducing controlled amounts of oxygen or $O_2$-containing gases into the chambers, so that the blanks are degassed more intensively and a partly combusted gas of increased $CO_2$ and CO content is generated and discharged. It is thus possible to favorably influence the quality of the coke blanks with respect to their content of volatile ingredients in view of their further use. For example, a produce containing 1.5% residual volatiles can be generated which can be used as an electrode coke.

According to the invention, the gas pressure in the chambers should be adjusted from 0 mm to 50 mm water column, preferably 5 mm to 10 MM of water column.

The method of the present invention has proven to be particularly economical energywise and environmentally safe if the blanks, after tempering, are placed into a closed cooling tank under exclusion of air and sprayed therein with water while withdrawing the forming water vapor from the bottom with overpressure.

Advantageously, the water vapor generated can be used in the plant as a secondary heating steam for cleaning the dust-laden gas produced when mixing the various coal components ahead of the briquetting press. All tar-carrying pipes can be heated with the recovered steam so that deposits and clogging inside the pipes are prevented.

For the execution of the method according to the invention, it is proposed that, in contrast to the several vertical hardening tanks now commonly used, in which one after the other are filled with hot briquettes and then emptied, the hardening system consist of a single, cube-shaped tank, one corner of which is inclined downwardly and which is divided into several narrow chambers by walls disposed parallel to the inclined outside surface, and which has a channel for charging the hot briquettes and for discharging the gases generated in tempering above an upper lateral edge and has an emptying channel for the rehardened blanks diagonally opposite the charging channel, underneath a lower lateral edge.

Due to the severe inclination of the bottom and side surfaces of the individual chambers, it is advantageously assured that the blanks keep sliding down automatically. It has also proven to be advantageous for the inclination of the bottom and side surfaces of the individual chambers to be about 45°, but is also possible to work with smaller angular inclinations, if the flow of the hot briquettes should so permit or require.

The advantages of arranging several narrow chambers in the cube-shaped tank lie in the compact space and material saving design which, practically, only requires outside walls for one tank and only partitions otherwise, in comparison to conventional single tanks.

Another advantage, according to the invention, is the absence of costly helical structures inside of the individual tank chambers. The present vertical hardening tanks require the installation of expensive helical chutes to prevent the hot briquettes from breaking apart due to the great drop height and the fact that the solidification of the blanks is not yet concluded when being loaded. With the proposed inclination of the bottom and side surfaces of the new tank system, the hot briquettes keep sliding down very easily and the originating abrasion is insignificant.

According to the invention, it is proposed to dispose only one of each gastight devices at the briquette entry point into the hot stuff conveyor, after the briquetting press and, at the discharge point from the emptying channel, the shutoff elements for the briquette transport control above and below each individual chamber are not of a gastight design. Therefore, only two gastight devices are required in total for all of the chambers, which devices, due to their complicated design, particularly at the high temperatures of about 500° C., require considerable financial outlay and can readily lead to breakdowns in operation. Much less expensive and simpler grates, flaps or slides can be chosen for the shutoff elements at each individual chamber.

It is a peculiarity of the proposed tank system that the charging channel is also a gas collecting pipe and that, after the gas discharge point, only a single pressure regulator is present for the control of the different gas quantities produced in the various hardening chambers as a function of the respective tempering time. Thus, it is possible to maintain the same slight overpressure in each chamber and at any time.

The charging channel and gas collecting pipe unit is also advantageous for the reason that possible encrustations and cakings at the upper openings of the chambers, brought about by the discharging crude gas are again removed every time blanks are filled in through the same openings. All deposits are rubbed off again in every filling operation by the dry and hot bulk material. In addition, the high temperature of about 500° C. of the arriving blanks substantially prevents the formation of condensation and corrosion.

The proposed combination method of rehardening and cooling of the hot briquettes offers considerable advantages over the hitherto known process phases, in particular, in the area of environmental protection. The coal gas forming in the tempering of the briquettes is recovered in a simple manner. In addition, the heat which is freed during cooling of the hot briquettes is ingeniously utilized by generating steam.

In accordance with the invention, hot briquettes are produced using a briquetting material of non-caking components which comprises delivering the components in the temperature range of about 430° C. to 540° C. into a briquetting press to form briquette blanks, and tempering and degassing the blanks by delivering them into individual chambers of a closed system of several chambers having gas communication therebetween so that there is partly changing amounts of gas generated in the individual chambers to form the tempered briquettes, and applying an overpressure to the chambers to conduct the generated gas away from the chambers with the same overpressures.

Accordingly, an object of the present invention is to provide a device for producing hot briquettes which comprises a substantially cube-shaped tank having one corner which is inclined downwardly which is divided into several relatively narrow substantially parallel chambers and which includes a channel disposed along the upper edge of the cube-shaped tank for charging the hot briquettes into the tank and for conducting away gases formed during tempering and which further includes an emptying channel disposed along the lower edge of the tank for receiving the rehardened blanks after they are tempered in the chambers.

A furtherr object of the present invention is to provide an apparatus for producing hot briquettes which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

DESCRIPTION OF THE PREFERRED EMBODIMENTS

Figure 1:
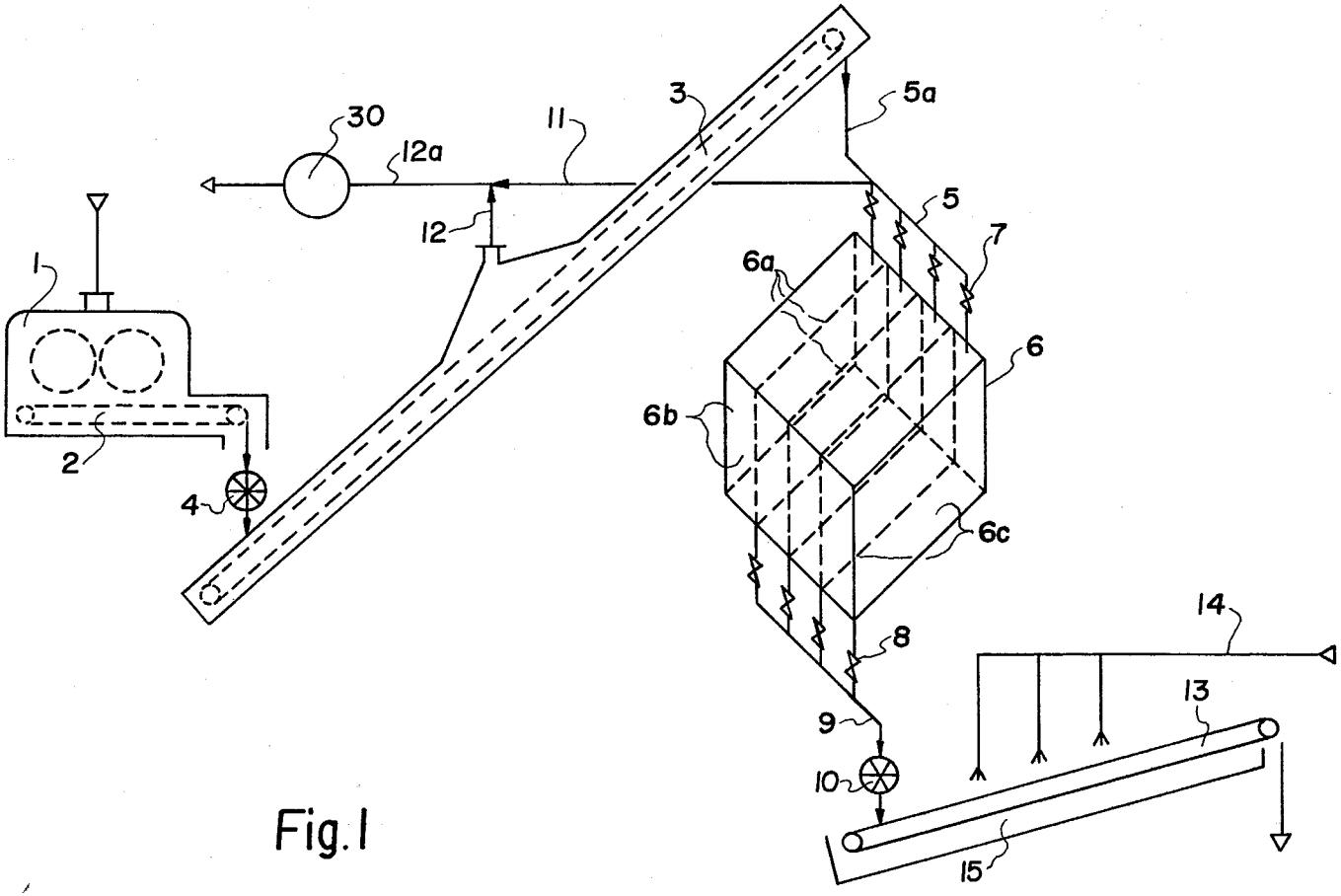
FIG. 1 is a schematic representation of the apparatus for the production of hot briquettes in accordance with the invention.
Figure 2:
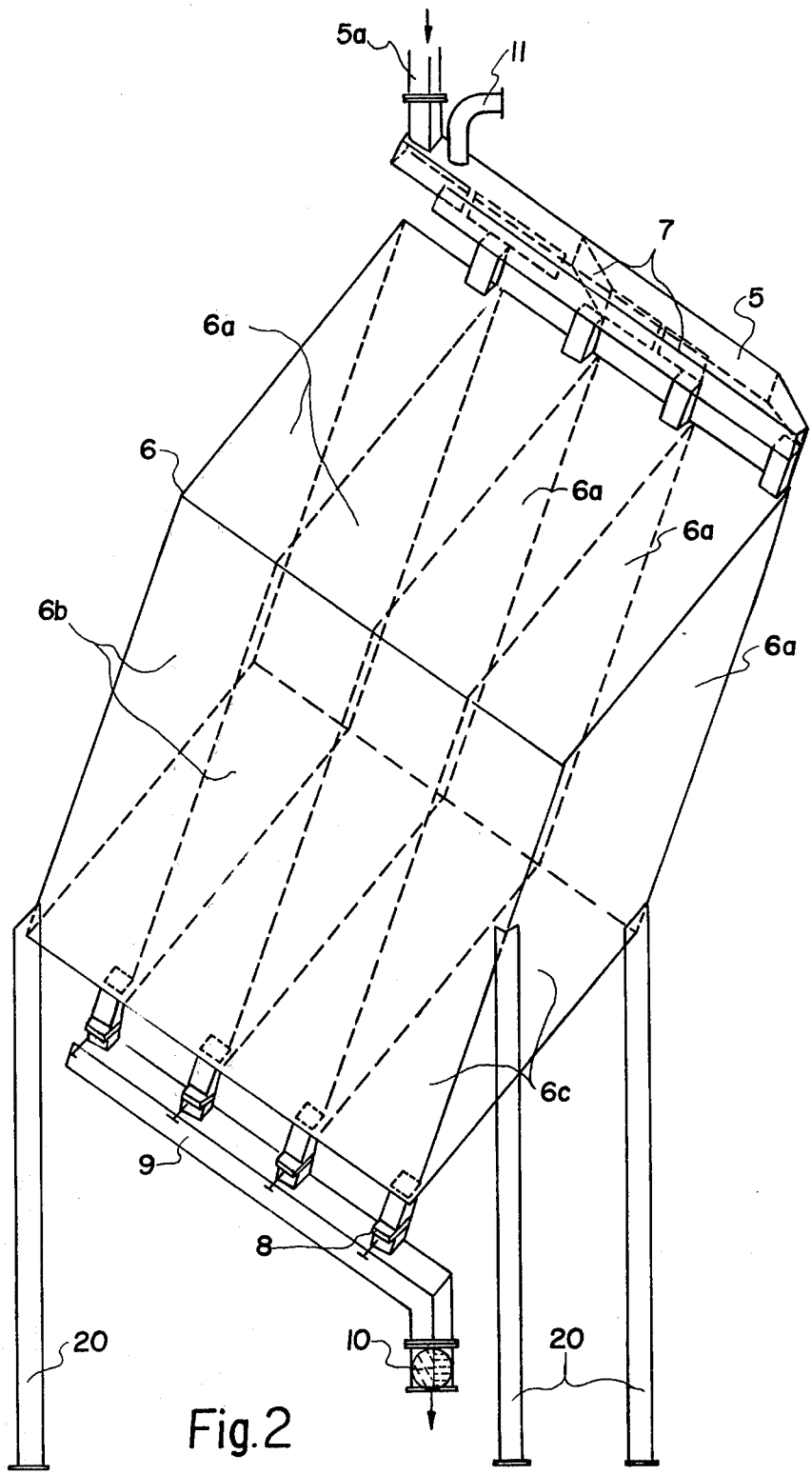
FIG. 2 is an enlarged perspective view of the tank employed for tempering the briquettes.

Referring to the drawings in particular, the invention embodied therein, comprises a method for the production of hot briquettes using a briquetting material of non-caking components such as low temperature coke from bituminous coal and/or lignite, coke dust and/or oil coke and caking fat coal at temperatures in the range of about 430° C. to 540° C.

After a process, according to the state of the art, hot briquettes are produced at a temperature of from about 430° C. to 540° C., by compacting a briquetting material of non-softening solids and caking coal in a roller press 1. In the example shown, the hot briquettes are fed to the hardening system by a honeycomb conveyor belt 2, to a gastight bucket wheel 4 and then to a hot stuff conveyor 3, all of which are under the exclusion of air and slight overpressure.

According to the invention, the hardening system consists of a single, cube-shaped tank 6, divided by parallel, spaced apart walls **6*a* into several substantially identical chambers 6*b*. The cube-shaped tank 6 is mounted on a three-legged supporting frame 20** (FIGS.

2 and 3), so that one corner of the cube points downwardly, causing a bottom 6c and side surfaces 6a of the individual chambers 6b to be severely inclined. This assures that the blanks automatically keep sliding. After leaving the hot stuff conveyor 3, the hot briquettes are transported via a chute 5a into a charging channel 5 disposed at the upper lateral edge of the cube-shaped tank 6. The briquettes are delivered from the channel into one of the respectively provided chambers 6b after selective actuation of the shutoff elements 7.

The hardening system is normally run in the sequence "filling, tempering without motiion of the solids (briquettes), emptying". This requires at least three chambers 6b. Tempering with motion of solids can also be done with fewer chambers 6b. Emptying of the individual chambers 6b is accomplished through an emptying channel 9 and a gastight bucket wheel 10 by opening valves or shutoff elements 8 provided at the bottom of the individual chambers.

The degassing gas which is freed during the tempering of the hot briquettes in the tank chambers 6b flows in an opposite travel direction to the hot briquettes through the shutoff elements 7, which are designed as grates, and the charging channel 5, out of the hardening system through the outlet 11 and is conducted away for further use through a line 12a, together with the gas drawn from the hot stuff conveyor 3 through a line 12. The control of the coal gas quantity generated and of the uniform, slight gas overpressure in the hardening system is accomplished by a single pressure regulator 30 in the line 12a.

Figure 3:
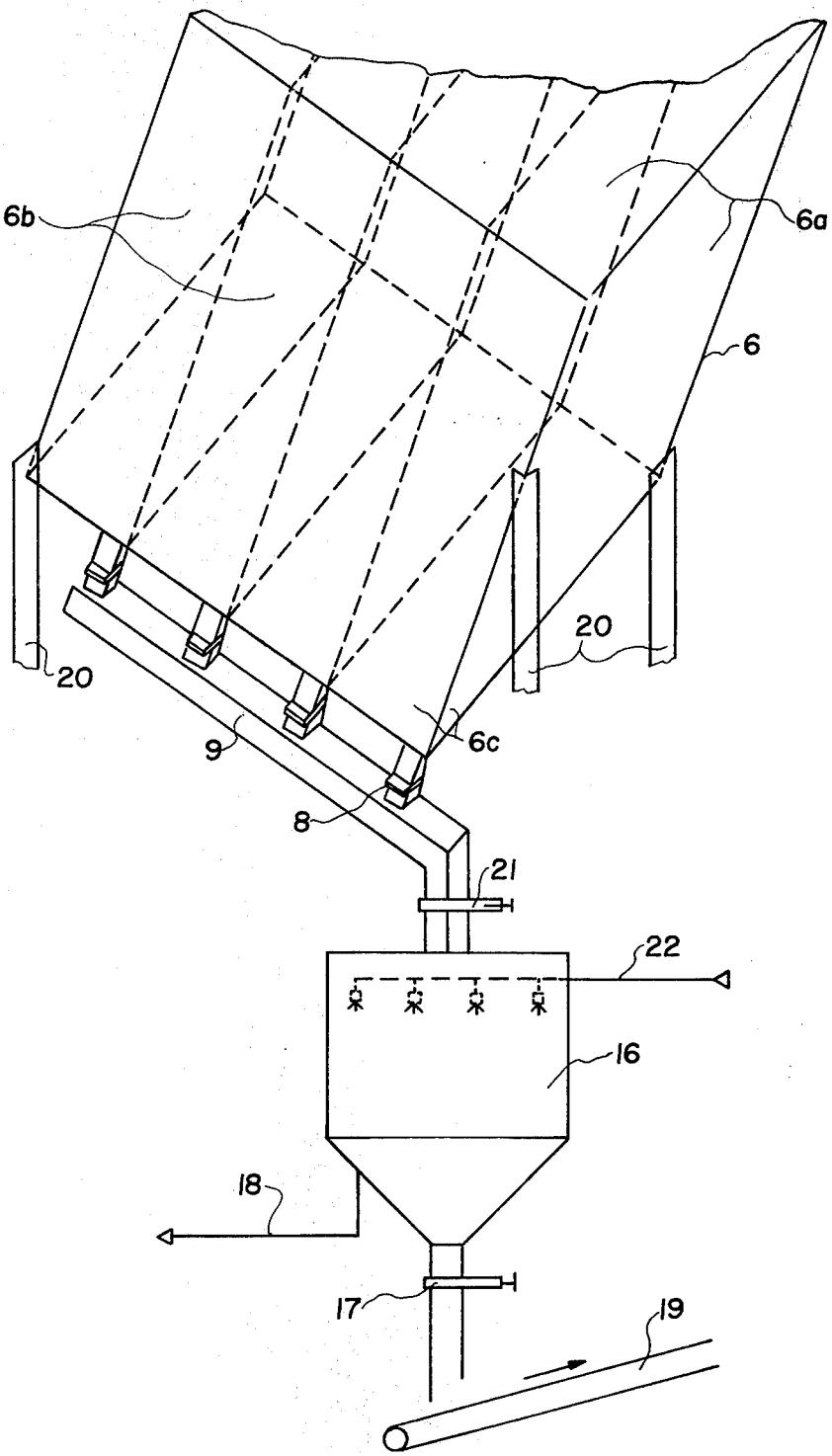
FIG. 3 is a view similar to FIG. 2 of another embodiment of the invention showing a closed discharging tank arrangement.

Cooling of the hot briquettes after they leave the bucket wheel 10 is shown schematically in FIG. 1. The tempered hot briquettes drop into a water immersion tank 15, from which they are conveyed by a conveyor belt 13, with a possibly required resprinkling being attended to by a sprinkling system 14. According to the invention, the cooling of the hot briquettes in a closed cooling tank directly coupled to the hardening system is shown in FIG. 3.

Whereas, the tempered hot briquettes were discharged continuously through the gastight bucket wheel 10 in the example of FIG. 1, emptying of the individual chambers 6b into a closed quenching or cooling tank 16 (FIG. 3) is advantageously carried out discontinuously in a very short period of time after tempering. By opening the shutoff fitting 21 which closes gastight, the hot content (400°–500° C.) runs out of the selected tank chamber 6b into the quenching tank 16 disposed beneath the hardening tank 6 in about one minute. After closing the shutoff fitting 21, a nozzle system 22 is operated to spray water into the quenching tank 16, cooling the hot briquettes in a short time to 150° C. to 200° C. The shutoff fitting 17 below the tank 16 is tightly closed during the quenching operation.

The water vapor forming during the cooling is removed under pressure regulation (about 0.5 to 3 bar) through a line 18 and is used elsewhere. The fitting 17 is opened after a short time and the hot briquettes, which are already greatly cooled down, are transported away by a conveyor belt 19 and, if needed, are subsequently cooled to the required shipping temperature by water sprinkling (similar to FIG. 1).

EXAMPLE FOR ONE APPLICATION OF THE INVENTION:

30 t/h (≙50 $m^3$h) hot briquettes are produced in a roller press 1 and fed to the hardening tank system via the honeycomb conveyor belt 2, bucket wheel 4 and hot stuff conveyor 3. The dimensions of the cube-shaped tank 5 are 7.2×7.2×7.2 m, and, in this case, the tank 6 is divided into four tank chambers 6b of the dimensions 7.2×7.2×1.8 m (V≈90 $m^3$). The chambers are run in the following work cycle:

First chamber: Fill, 1.5 h
Second chamber: Temper without motion of solids, 1.5 h
Third chamber: Empty 1.5 h
Fourth chamber: Kept empty in reserve With this arrangement, the tempering time is about three hours, with the tanks being filled with about 75 $m^3$ of briquettes each time.

A typical hot briquette analysis before entry into the hardening tank is as follows:

Size: 50 $cm^3$
Volatiles: 9.0%
Ash: 7.0%
C fixed: 84.5%
Spot compressive strength: 1 200 N.

After tempering, prior to entry into the cooling tank 16, the briquette has the following analysis:

Volatiles: 7.5%
Ash: 7.0%
C fixed: 85.5%
Spot compressive strength: 2 600 N.

The following amount of gas is recovered in the average per hour through line 12:

Quantity: 450 $m^3$/h
Calorific value: 21000 kJ/$m^3_n$.

In the combination rehardening/cooling, the briquettes are cooled from 450° C. to 180° C., with about 7 t of steam being produced per tank chamber from 45 t hot briquettes at about 2 bar pressure (saturated steam).

While specific embodiments of the invention have been shown and described in detail to illustrate the application of the principles of the invention, it will be understood that the invention may be embodied otherwise without departing from such principles.

What is claimed is:

1. A method for the production of hot briquettes, using a briquetting material of non-caking components, such as low temperature coke from bituminous coal and/or lignite, coke dust and/or oil coke and caking fat coal at temperatures between around 430° C. to 540° C., comprising, delivering the briquetting material to a briquetting press to form briquette blanks, tempering and degassing the blanks by delivering the blanks into individual chambers in a closed system of several side-by-side chambers having gas communication between the chambers so that there is partly changing amounts of gas generated in the individual chambers so as to form the hardened tempered briquettes, and applying an overpressure to the chambers to conduct the gases away from individual chambers together with one and the same overpressure.

2. A method for the production of hot briquettes, as claimed in claim 1, wherein a rich gas comprising predominantly hydrogen, methane and ethane is produced and recovered by tempering the blanks at temperatures up to a maximum of 100° C. below the briquette pressing temperature and without the introduction of additional heat.

3. A method for the production of hot briquettes, as claimed in claim 1, wherein the temperature of the blanks is raised by introducing controlled amounts of oxygen or oxygen-containing gases into the individual chambers, degassing the blanks more intensively by the introduction of the oxygen and generating and recovering a partly combusted gas of increased $CO_2$ and CO content.

4. A method for the production of hot briquettes, as claimed in claim 1, wherein the gas pressures in the chambers is adjusted from 0 mm to 50 mm of water column, and preferably from 5 mm to 10 mm of water column.

5. A method for the production of hot briquettes, as claimed in claim 1, wherein after tempering, the blanks are put into a closed cooling tank under exclusion of air and are sprayed with water so as to generate a water vapor and recovering the water vapor at the bottom with an overpressure applied to the cooling tank.

6. A method for the production of hot briquettes, as claimed in claim 5, wherein the water vapor produced in the cooling tank is used as a secondary steam to clean the gas generated in the installation.

7. An apparatus for the production of hot briquettes, comprising, a cube-shaped tank having one corner which is lowermost inclined downwardly in the remainder of the tank, said tank being divided by a plurality of partitions into a plurality of side-by-side narrow chambers, each of which is inclined downwardly, a channel extending along the upper edge of said tank having a separate discharge into each of said chambers for discharging the hot briquettes, said discharges acting also as means for conducting away the gases formed in the chambers during tempering, and an emptying channel disposed along the lower edge of said tank and connected into the interior chambers for receiving and discharging the rehardened tanks.

8. An apparatus for the production of hot briquettes, as claimed in claim 7, wherein the inclination of the bottom and side surfaces of said tank and the individual chambers is about 45° .

9. An apparatus for the production of hot briquettes, as claimed in claim 7, including a hot stuff conveyor, press means connected to said hot stuff conveyor having a gastight device for feeding briquettes into the lower end of said conveyor, said conveyor being disposed to deliver the briquettes up to the charging channel of said cube-shaped tank and a gastight emptying device connected to said discharge channel from said tank for delivering said briquettes into a cooling device.

10. An apparatus for the production of hot briquettes, as claimed in claim 9, including a discharge for gases connected to said charging channel and a single pressure regulator in said discharge for regulating various amounts of gas generated in the various hardening chambers.

* * * * *